United States Patent [19]

Musschoot

[11] Patent Number: 4,561,598

[45] Date of Patent: Dec. 31, 1985

[54] APPARATUS FOR GRINDING, MILLING, CRUSHING, SCRUBBING, SIZING AND/OR CLASSIFYING MATERIAL

[75] Inventor: Albert Musschoot, Barrington, Ill.

[73] Assignee: General Kinematics Corporation, Barrington, Ill.

[21] Appl. No.: 560,858

[22] Filed: Dec. 12, 1983

[51] Int. Cl.[4] ..... B02C 17/14

[52] U.S. Cl. ..... 241/19; 241/24; 241/26; 241/79.1; 241/175; 241/284

[58] Field of Search ..... 241/69, 79.1, 19, 30, 241/26, 24, 284, 175, 283, 184, 5, 39

[56] References Cited

U.S. PATENT DOCUMENTS

| | | | |
|---|---|---|---|
| 2,298,015 | 10/1942 | Lincoln | 241/175 X |
| 2,911,160 | 11/1959 | Hartwig | 241/175 |
| 3,078,048 | 2/1963 | Russell et al. | 241/19 X |
| 3,310,245 | 3/1967 | Decker et al. | 241/175 X |
| 3,350,020 | 10/1967 | Chamberlain | 241/175 X |
| 3,841,572 | 10/1974 | Cordoba . | |
| 3,856,217 | 12/1974 | Brewer | 241/79.1 |
| 4,354,641 | 10/1982 | Smith | 241/79.1 X |

FOREIGN PATENT DOCUMENTS

| | | |
|---|---|---|
| 795355 | 5/1958 | United Kingdom . |
| 1014950 | 12/1965 | United Kingdom . |
| 1064519 | 4/1967 | United Kingdom . |
| 1189201 | 4/1970 | United Kingdom . |
| 1266328 | 3/1972 | United Kingdom . |

OTHER PUBLICATIONS

Palla Vibration Mills Bulletin No. 2-171e, KHD Industrieanlagen AG-Humboldt Wedag, 8-1978.

*Primary Examiner*—Mark Rosenbaum

*Attorney, Agent, or Firm*—Wood, Dalton, Phillips, Mason & Rowe

[57] ABSTRACT

A vibratory apparatus is disclosed for scrubbing, abrading, pulverizing, grinding, crushing, milling and/or separating granular material. The apparatus includes a two mass vibratory system with a tube, as part of the working mass, provided for the granular material and having an inlet end and an outlet end open to a stack at a location lower than the inlet end. The stack has means for creating an upward countercurrent air flow therethrough. A driving mass, including a vibration generating assembly, is provided for vibrating the driving mass and the working mass so that the granular material is agitated in the tube at large accelerations to scrub, abrade, pulverize, grind, crush or mill the granular material. When the apparatus is used as a separator or classifier, the countercurrent air flow in the stack causes minute particles to move up through the stack to separate the minute particles from the batch of granular material as the material is discharged into the stack. A matrix or media, such as balls, may be located in the tube to crush, grind or mill the material passing through the tube to reduce the size of the material. A method is also disclosed which includes the steps of feeding granular material into a tube as described above, vibrating the tube to agitate the granular material, and creating a countercurrent air flow over the outlet end of the tube to move the minute particles away from the falling granular material.

10 Claims, 6 Drawing Figures

66
60
88
94
84
86
92
93
57
90
58
81
55
82
54
56
42
24
30
34
32
36
80
96
98
100

APPARATUS FOR GRINDING, MILLING, CRUSHING, SCRUBBING, SIZING AND/OR CLASSIFYING MATERIAL

BACKGROUND OF THE INVENTION

1. Technical Field

The present invention relates to an apparatus and method for vibrating, grinding, crushing, milling, scrubbing, sizing and/or classifying granular material.

2. Background Art

Granular material is used in many different applications where it is desirable before reusing to clean off particles such as a binder which has adhered to the granular material. One such application is in metal castings where binder is added to sand to form the mold. The mold is broken up when the casting is made. Though the binder is largely dissolved, minute particles nevertheless remain adhered to the grains of sand and some grains of sand will remain adhered to each other. It is desirable to remove the minute particles between uses so that the ability of the sand to bind in subsequent uses is not affected. It is further necessary to separate the removed particles from the sand to obtain clean sand without undesirable fine materials mixed therein.

Another example of foreign materials adhering to a part would be where a pattern of a part to be molded is made of styrofoam with a ceramic coating. When the mold is placed in a mold box and the metal poured therein the styrofoam mostly disappears leaving small deposits on the surface of the part and in the broken up sand mold. Cleaning the sand from the binders and the after effects of the casting step, and separating the binders from the cleaned sand is necessary and can be difficult.

Further, in grinding, crushing or milling applications where it is desired to render materials to a minute size, the capacity of milling machines has been somewhat limited in view of the time required for such milling.

The present invention is directed toward overcoming one or more of the problems as set forth above.

SUMMARY OF THE INVENTION

In one aspect of the present invention, an apparatus is disclosed for vibratory scrubbing and countercurrent classifying of grades of granular material. The apparatus includes a stack and means for creating an upward air flow in the stack. A chute is provided for receiving the granular material having an inlet end and an outlet end open to the stack at a location lower than the inlet end. Apparatus is provided for vibrating the chute so that the granular material is agitated in the chute to scrub the minute particles from the grains of granular material, and the countercurrent air flow causes the minute particles to move up through the stack to separate the particle and sand grain mixture.

In another aspect of the present invention, a method is disclosed which includes the steps of dumping the granular material into a chute as described above, vibrating the chute to agitate the granular material, and creating a countercurrent air flow over the outlet end of the chute to pull the minute particles away from the falling granular material.

With the present invention, granular material can be cleaned so as to scrub away any minute particles of foreign material which may adhere to the granular material, and the minute particles once removed are separated from the granular material so as to obtain a clean granular material which has the same characteristics as did the granular material in its previous uses.

The invention may also be used in reducing and/or pulverizing material and classifying the resultant product. The apparatus will reduce, mill or pulverize coal which will then be classified by countercurrent flow.

In still another aspect of the present invention, a two mass vibratory apparatus is disclosed having a matrix or media for grinding, crushing or milling of the material placed therein. Large accelerations are created by the vibration of the apparatus so that grinding, crushing or milling is accomplished in a more uniform manner and at a higher rate and thus the capacity of the apparatus is improved.

DESCRIPTION OF THE PREFERRED EMBODIMENT

Figure 1:
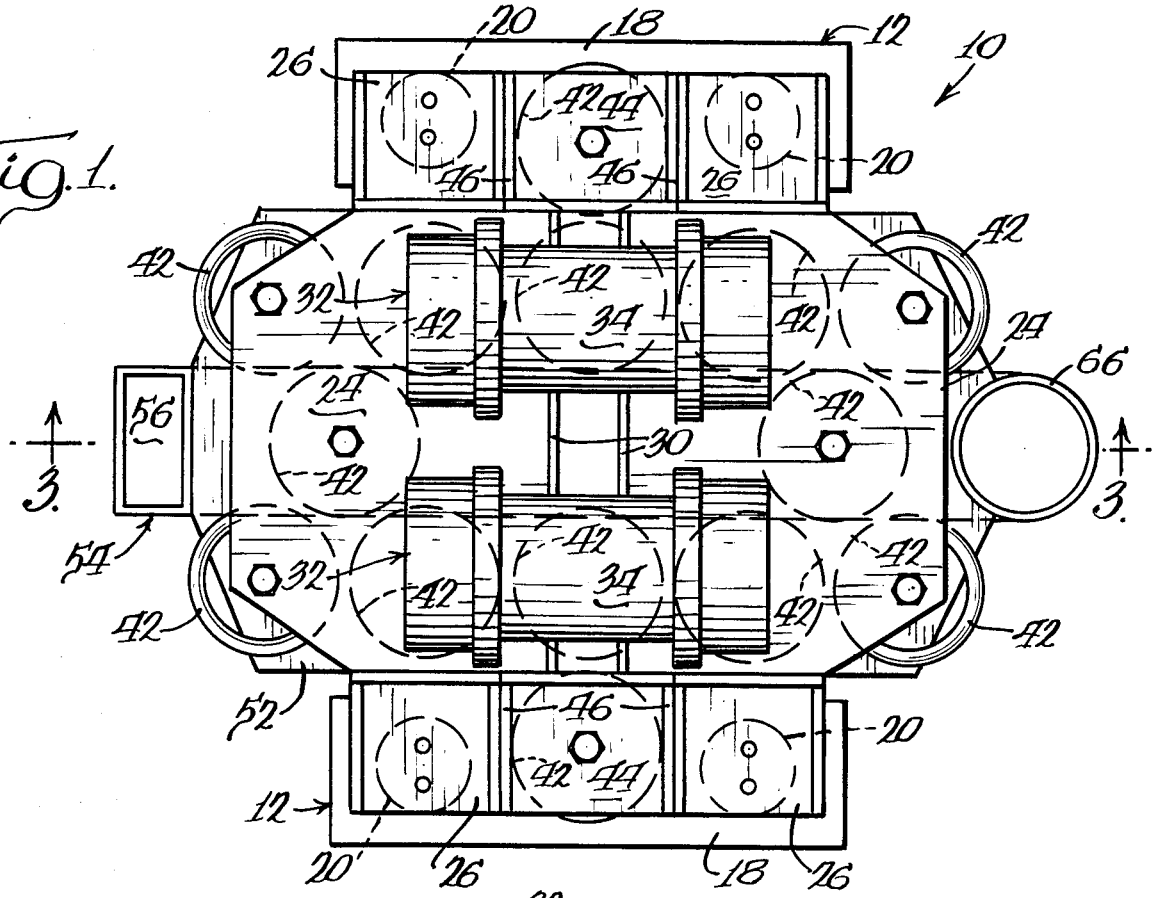
FIG. 1 is a top view of the scrubber for granular material.
Figure 2:
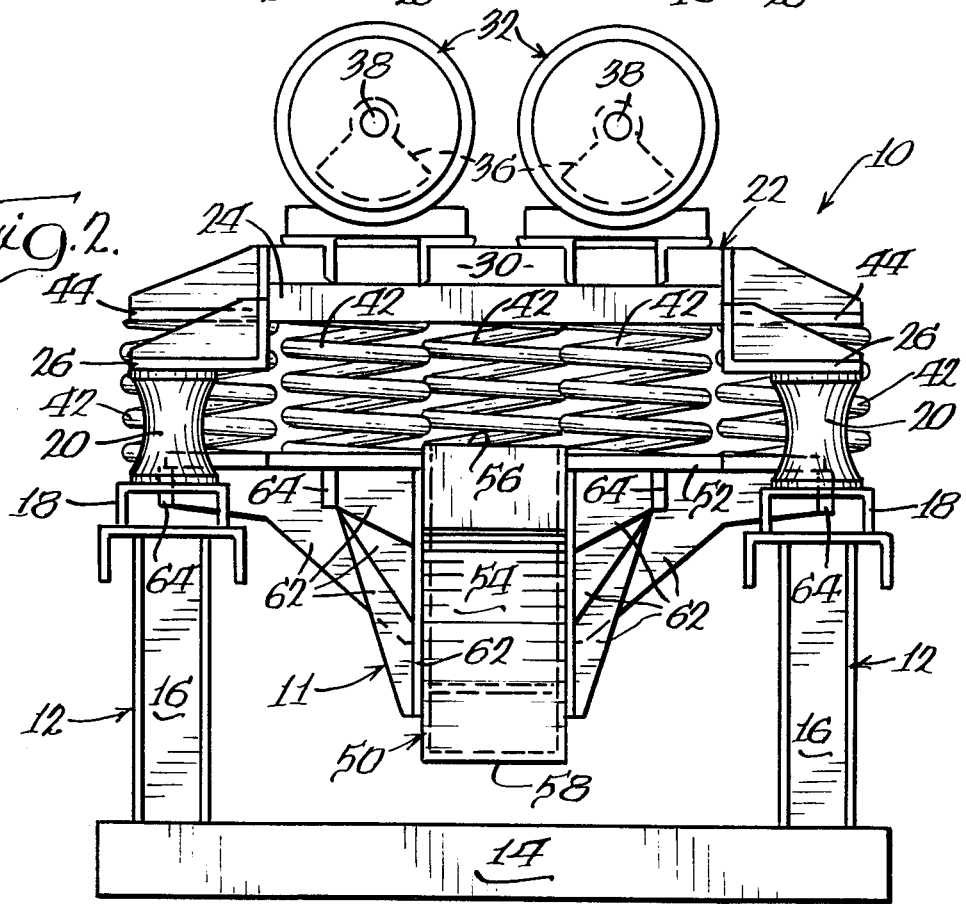
FIG. 2 is a side view of the scrubber.
Figure 3:
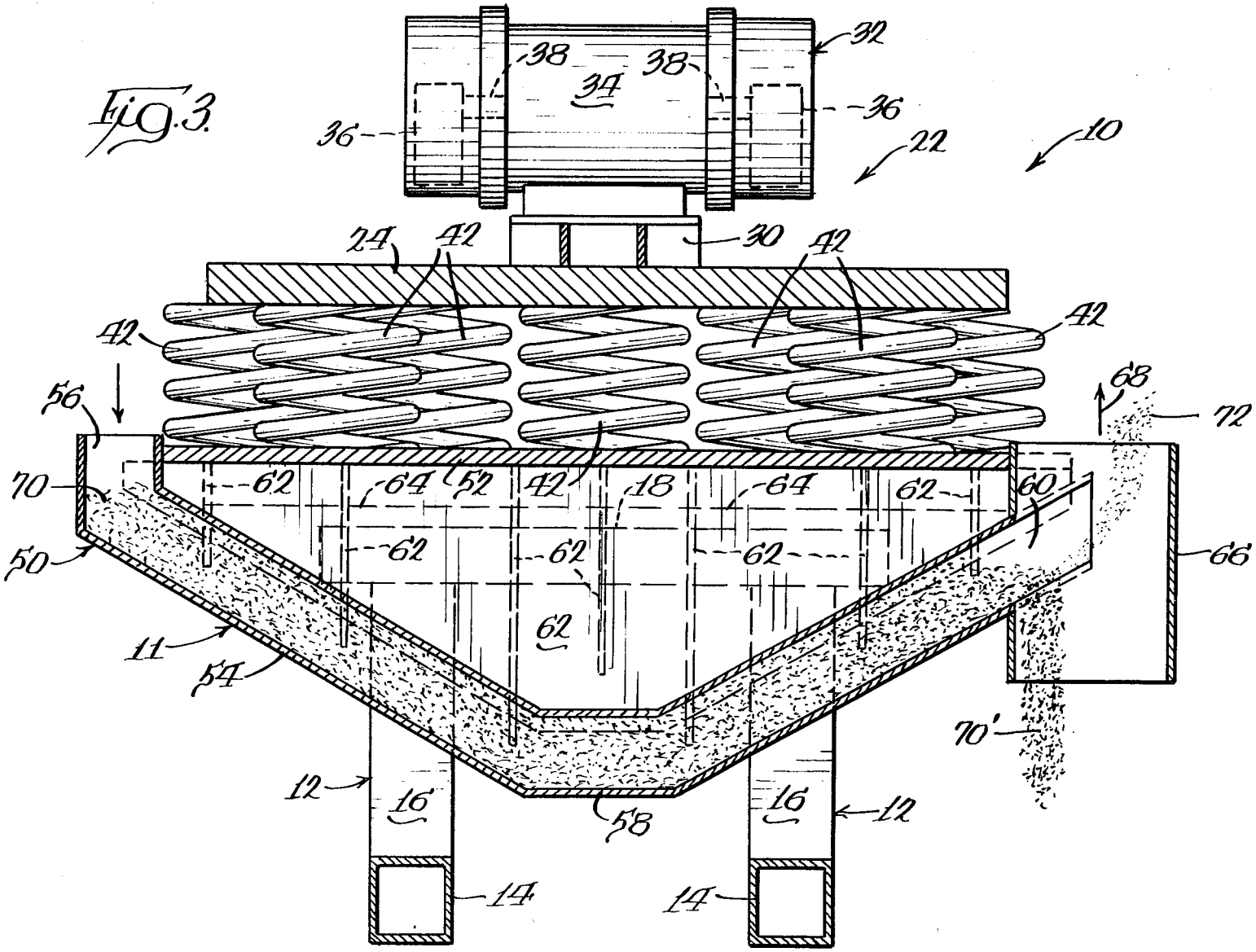
FIG. 3 is a cross-sectional view of the scrubber taken along line 3—3 in FIG. 1.

The vibratory apparatus 10, which in FIGS. 1-3 is used as a scrubber 11, scrubs granular material to separate adhered granular material and remove minute particles of foreign material which are adhered to the grains of granular material. The apparatus includes a base 12 having a bottom portion 14 fixed to the ground or to a foundation and upright pillars 16. The pillars 16 associated with opposite bottom portions 14 are interconnected by transverse beams 18 and at the top at each end support resilient isolation bumpers 20 (see FIGS. 1 and 2).

A motor driving mass 22 includes a rigid motor plate 24, a mounting support 30 and a vibration generator 32. The driving or motor mass 22 is resiliently supported on the ground or foundation by four support brackets 26 suitably secured to the sides of the motor plate 24 which brackets bear on the isolation bumpers 20 carried by the pillars 16.

Secured to the top of the plate 24 is a mounting support 30 for supporting the vibration generator 32. The generator 32 shown includes a pair of electric motors 34 having eccentric weights 36 on their shafts 38. The motors 34 are symmetrically spaced on the mounting support and on the plate 24 and rotate in opposite directions so that the resultant vibratory force produced by the generator 32 is straight-line.

In the present example, a total of fourteen springs 42 are shown suspended from the driving mass 22. Twelve of the springs 42 are suspended from the plate 24. Two springs 42 are suspended from spring brackets 44 which are suitably secured to the plate 24 so that the bottom of each bracket 44 is flush with the bottom of the plate 24 (see FIG. 2). The spring brackets 44 are located between the support brackets 26. Of course, other numbers of springs 42 could be provided as well, it being preferable however that the springs 42 be symmetrical about the center of the scrubber 11.

A working mass 50 is suspended from the springs 42. Specifically, a working plate 52 is suitably fixed to the bottom of the springs 42. Rigidly fixed to the working plate 52 is a tube or chute 54 having an inlet end 56, a low intermediate portion 58, and an outlet end 60. The outlet end 60 is lower than the inlet end 56. A number of mounting plates 62 and braces 64 are fixed to the bottom of the working plate 52 to rigidly and securely mount the chute 54. Strong mounting of the chute 54 is necessary because of the extensive vibratory accelerations which the working mass 50 will be subjected to.

The chute 54 has the downwardly sloping portion 55 joined with the horizontal intermediate portion 58 which is joined with the upwardly sloping portion 57 terminating at the outlet end 60 in the stack 66. The shape of the chute 54 is such as to cause the grains of granular material to abrade each other along different relative paths with the downward and upward sloped portions of the chute creating different directions of the forces acting on the granular material to tumble, roll, hammer and generally to agitate the material to effect a more thorough scrubbing action between adjacent grains.

The outlet end 60 of the chute 54 opens into a vertical stack or shaft 66. A suction source (shown schematically by the arrow 68) is provided at the top of the stack 66 which thereby creates an upward or countercurrent air flow through the stack 66 for a purpose which will become apparent.

Operation of the scrubber 11 is thus as follows. The motors 34 are energized so that the eccentric weights 36 create an acceleration on the motor mass 22 of about 0 to 10 g's and more specifically, 2 to 3 g's. The two mass system can therefore be tuned so that the acceleration on the working mass 50 is in the range of 30 to 70 g's and more specifically 50 to 60 g's. With the two mass system appropriately tuned, the amplitude of the working mass 50 is greater than the amplitude of the driving mass 22.

The granular material 70 to be scrubbed can be continuously fed into the inlet end 56 of the chute 54. The large accelerations created by the vibration of the chute 54 cause the granular material 70 to become fluidized. The granular material will become fluidized when the amplitude and frequency of the vibrations of the working mass as applied in the formula $S \times F^2/70400$ is greater than one, with S being the amplitude in inches and F being the frequency in strokes per minute. The fluidized granular material 70 therefore flows through the chute 54 toward the outlet end 60 which is lower than the inlet end 56. The vibrations also cause the granular material 70 to agitate and abrade so that the grains of granular material strike each other and strike the side walls of the chute 54 to both separate adhered grains of granular material and to remove other minute particles, such as binder or residue, from the grains of granular material. Accordingly, at the outlet end 60, clean grains of granular material 70' and unwanted minute particles 72 pass into the stack 66. The upward or countercurrent air flow through the stack 66, though not sufficient to prevent the grains of granular material 70' from falling into a suitable recovery bin (not shown), does catch the smaller unwanted particles 72 and pulls them upward out of the stack 66 and into an appropriate collection system so as to separate the minute particles from the clean granular material 70'. The particles 72 are typically less than a micron in size, though the size of particles separated are dependent upon the air velocity in the stack 66. The particles 72 can be collected in any suitable receptacle or filter (not shown). The clean granular material 70' can accordingly be reused and the clean material will have the same characteristics as when it was first used.

The apparatus may be used to reduce, mill and/or pulverize material such as mineral ores, including coal. Crushed coal is fed into the chute 54 and is subjected to the vibratory accelerations sufficient to fluidize the crushed coal and move same through the descending and ascending portions of the chute. The granular particles of coal will abrade and mill against each other and against the sides of the chute to further pulverize the granular particles. As the granular particles exit the chute into the countercurrent air flow in the stack, the fines that are minute enough will become airborn and will be drawn from the exiting stream with the remaining, coarser granular particles of coal collecting in an appropriate collection chamber.

Figures 4, 5, 6:
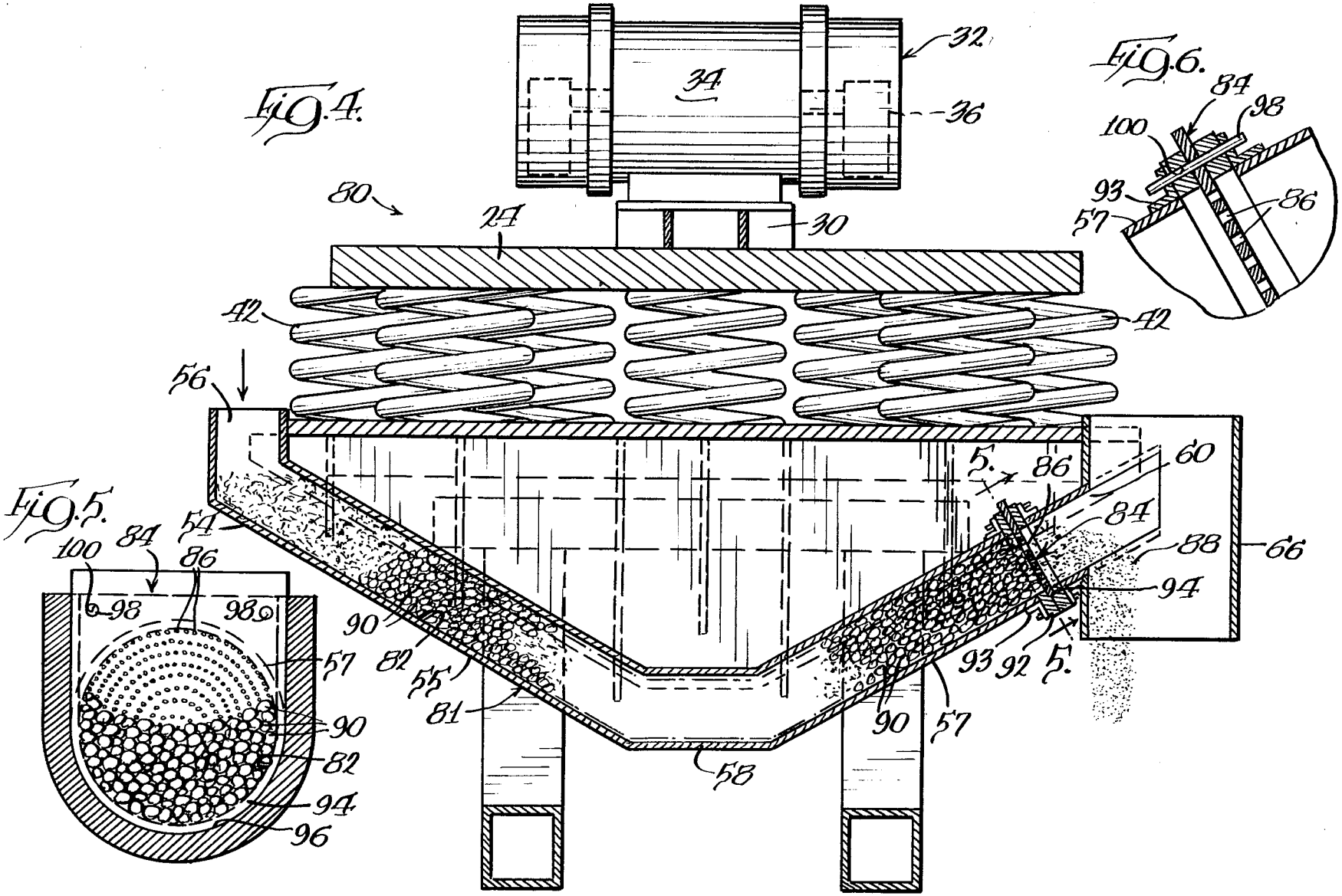
FIG. 4 is a cross-sectional view of an alternative embodiment used for milling materials.
FIG. 5 is a cross-sectional view taken along line 5—5 of FIG. 4.
FIG. 6 is a partial enlarged view of a portion of the screen retaining structure.

The present invention can also be used to crush, grind or to ball mill materials as is illustrated in FIGS. 4, 5 and 6. The vibratory apparatus 80 is used as a crushing mill, grinding mill or ball mill 81 with the vibration generating assembly substantially the same as for the scrubber 11 of FIGS. 1–3 (and thus the same reference numerals are used for similar parts) with the exception that the chute 54 includes grinding, crushing and/or milling media 82 and has a screen or separator plate 84 near its outlet end 60. As can be seen in FIGS. 4 and 5, the screen or separating plate 84 retains the matrix or media 82 within the chute 54 and includes a plurality of holes 86 therein through which the crushed, ground or milled materials 88 may pass. The sizes of the holes 86 are sufficient to pass the crushed, ground or milled material without clogging the chute but are small enough to retain the grinding media 82 in the chute.

The screen or separating plate 84 is mounted in the discharge portion of the chute 54 at substantially a right angle to the longitudinal axis of that portion of the chute in which the plate is located. As illustrated, the chute is provided with mating collars or flanges 92 surrounding a break in the chute with the collars or flanges being welded to the chute or being held by brackets 93 bolted thereto. The flanges have mating offsets 94 around approximately 180° of the cylindrical shape of the chute, which mating offsets 94 create a slot 96 in which the screen or plate 84 slides and nests. The screen or plate 84 is held in place in the mating flanges by pins 98 passing through aligned openings 100 in the flanges and in the screen or plate 94. The screen or plate 94 can be replaced with another plate having larger or smaller holes 86 as the situation demands. The screen or plate 84 can also be removed for cleaning and/or repairs.

The crushing, grinding or milling machine 81 uses a two mass system which can create substantially greater accelerations on the working mass 50 than the prior art (i.e. up to 70 g's versus 10 g's or less in the prior art), is capable of crushing, grinding and/or milling more thoroughly and at a faster rate, and thus has a greater capacity than comparable sized crushing, grinding and/or milling machines of the prior art.

Also with the present invention, where it is desirable to separate out particles below a particular size at the output of the crushing, grinding and/or milling chamber, a countercurrent air flow may be used in the vertical shaft 66 as previously described.

More specifically, the vibrating matrix or media 82 is shown in the form of balls 90, all of which may be the same general size or they may be a mixture of different sizes. The amount of media in the chute 54 will depend on the degree of grinding, crushing or milling is desired, the more media the greater the grinding, crushing or milling of the material. The shape of the chute 54, i.e. sloping downwardly at 55 and upwardly at 57 lends itself to having larger diameter balls in the downwardly sloped portion 55 for coarse grinding, crushing or milling and smaller diameter balls in the upwardly sloped portion 57 for finer grinding, crushing or milling. The vibratory motion of the chute is such as to fluidize the material being crushed, ground or milled so as to cause the material to flow through the chute as it is worked upon by the media. The vibratory motion of the chute causes the chute to act on the balls of the media in directions caused by the slopes of the chute which create forces on the balls and on the material that works on the material as it is crushed, ground or milled between the balls and between the balls and the chute.

The two mass system, when tuned to the material being worked upon, will crush, grind and/or mill the material as the material is fluidized and flows through the chute. The material will be sized depending on the diameter of the balls in the media and on the time it takes to pass through the apparatus.

Other aspects, objects and advantages of the present invention can be obtained from a study of the drawings, the specification and the appended claims.

I claim:

1. An apparatus for crushing, grinding or milling material, comprising:

a resiliently supported driving mass;

a working mass resiliently suspended from the driving mass;

tube means mounted on said working mass and forming a part of said working mass, said tube means moving with said working mass, having inlet and outlet ends, an intermediate portion, a downwardly sloping portion communicating between the inlet and intermediate portion, and an upwardly sloping portion communicating between the intermediate portion and the outlet, said tube means having substantially a uniform cross-section and enclosed between the inlet and outlet ends;

vibration generating means forming part of said driving mass whereby a batch of granular material fed into the inlet end of said tube means is fluidized by said vibration generating means for crushing, grinding or milling the material within the tube means;

a stack carried at the outlet end of the tube means; and means for creating a countercurrent air flow through the stack, whereby the material introduced at the inlet traverses the downwardly sloping, intermediate and upwardly sloping portions of the tube means and, as the crushed, ground or milled material exits the outlet end of the tube means, minute particles in the material are drawn clear from the remaining exiting material by the countercurrent air flow.

2. The apparatus of claim 1, further comprising:

media means for acting on said material within the tube means; and screen means for screening the material from the media means, the screen means being mounted in the outlet portion of the tube means and retaining the media means within the tube means while allowing passage therethrough of the crushed, ground or milled material.

3. The apparatus of claim 2 wherein the media means comprises plural balls of the same diameter.

4. The apparatus of claim 2 wherein the media means comprises plural balls of at least two different diameters.

5. The apparatus of claim 2 wherein the screen means is removably mounted in said outlet portion of the tube whereby the screen means may be removed for cleaning or for replacement.

6. The apparatus of claim 1 wherein the amplitude of the working mass is greater than the amplitude of the driving mass.

7. The apparatus of claim 6 wherein:

the driving mass is resiliently supported on a foundation; and the working mass is suspended by spring means from the driving mass.

8. The apparatus of claim 1 wherein the countercurrent air flow creating means comprises suction means at the top of the stack.

9. The apparatus of claim 1 wherein the vibration generating means is tuned to vibrate the tube means at an acceleration in the range of up to 70 g's.

10. A method for scrubbing, pulverizing and separating minute particles of material from a batch of granular material, comprising the steps of:

dumping the granular material into an enclosed tube having substantially a uniform cross-sectional configuration, an inlet end and an outlet end lower than the inlet end;

causing the material dumped into the tube to travel downwardly through the tube to an intermediate portion and upwardly through the tube from the intermediate portion to the outlet end;

vibrating the tube to fluidize the granular material and to agitate the granular material as it traverses between the inlet and outlet ends to scrub and pulverize minute particles of material from the batch of the granular material; and separating the minute particles from the mixture of minute particles and granular material.

* * * * *